US008066125B2

(12) United States Patent
Kang et al.

(10) Patent No.: US 8,066,125 B2
(45) Date of Patent: Nov. 29, 2011

(54) COMPACT INJECTION MOLDED BATTERY PACKAGE

(75) Inventors: Donwoong Kang, Camillus, NY (US); Tyler T. Watson, Auburn, NY (US); Scott W. Osiecki, Skaneateles, NY (US); Mark A. Ferguson, Memphis, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 130 days.

(21) Appl. No.: 12/145,716

(22) Filed: Jun. 25, 2008

(65) Prior Publication Data

US 2009/0321303 A1 Dec. 31, 2009

(51) Int. Cl.
*B65D 85/88* (2006.01)

(52) U.S. Cl. ..... 206/705; 206/470; 206/461

(58) Field of Classification Search ..... 206/703, 206/704, 461, 467, 470, 471, 775, 776, 705
See application file for complete search history.

(56) References Cited

U.S. PATENT DOCUMENTS

| | | | | | |
|---|---|---|---|---|---|
| 2,937,749 | A | * | 5/1960 | Strzala | 209/531 |
| 4,349,102 | A | * | 9/1982 | Strongwater | 206/45.24 |
| 4,412,616 | A | * | 11/1983 | Williams | 220/524 |
| 4,415,084 | A | | 11/1983 | Hauser et al. | |
| 4,568,017 | A | | 2/1986 | Grunert | |
| 4,739,883 | A | * | 4/1988 | Mohs et al. | 206/470 |
| 4,899,882 | A | | 2/1990 | Benner | |
| 4,930,627 | A | | 6/1990 | Borst et al. | |
| 4,962,849 | A | | 10/1990 | Anderson | |
| 5,011,006 | A | | 4/1991 | Anderson | |
| 5,012,927 | A | | 5/1991 | Borst | |
| 5,038,936 | A | | 8/1991 | Borst | |
| 5,147,035 | A | | 9/1992 | Hartman | |
| D346,114 | S | * | 4/1994 | Winston | D9/415 |
| 5,462,161 | A | | 10/1995 | Halaburda et al. | |
| 5,485,919 | A | | 1/1996 | Samberg et al. | |
| D393,799 | S | | 4/1998 | Pope et al. | |
| 5,735,404 | A | * | 4/1998 | Kumakura et al. | 206/469 |
| 5,803,254 | A | | 9/1998 | Vasudeva | |
| 5,849,378 | A | | 12/1998 | Gask | |
| 6,059,101 | A | | 5/2000 | Gambardella et al. | |
| D432,909 | S | | 10/2000 | Pirro et al. | |
| D433,629 | S | | 11/2000 | Clarke et al. | |
| 6,244,444 | B1 | * | 6/2001 | Jacobus et al. | 206/703 |

(Continued)

FOREIGN PATENT DOCUMENTS

| | | |
|---|---|---|
| EP | 711713 | 3/1999 |

(Continued)

*Primary Examiner* — Mickey Yu
*Assistant Examiner* — Chun Cheung
(74) *Attorney, Agent, or Firm* — Michael C. Pophal

(57) ABSTRACT

A package comprising a rear member pivotally connected to a front member at a pivot. The package has a closed position wherein the front member is engaged with the rear member to define an interior space therebetween and an open position allowing access to the interior space. At least one of the front member and the rear member includes support structure for supporting products in the interior space. A projection having an aperture for allowing the package to be hung on a rod extends from the front member and the rear member. The rear member includes a foot allowing the package to stand substantially upright on a horizontal surface. The front member and the rear member include a latch and a slot, with the latch being configured to be inserted into the slot for maintaining the package in the closed position.

10 Claims, 7 Drawing Sheets

U.S. PATENT DOCUMENTS

| | | | | |
|---|---|---|---|---|
| 6,364,115 | B1 | 4/2002 | Casanova et al. | |
| 6,382,412 | B1 | 5/2002 | Wood | |
| 6,401,932 | B1 | 6/2002 | Weinstein et al. | |
| 6,427,841 | B2 | 8/2002 | Wani et al. | |
| 6,478,158 | B2 | 11/2002 | Gaffney et al. | |
| 6,659,272 | B2 * | 12/2003 | Bellin et al. | 206/232 |
| 6,679,630 | B2 | 1/2004 | Knoerzer et al. | |
| D489,253 | S | 5/2004 | Kumakura et al. | |
| D494,464 | S | 8/2004 | Kumakura et al. | |
| D497,547 | S | 10/2004 | Kumakura et al. | |
| D501,137 | S | 1/2005 | Fritz et al. | |
| 7,404,487 | B2 * | 7/2008 | Kumakura et al. | 206/469 |
| 2001/0008240 | A1 | 7/2001 | Herrin | |
| 2002/0162771 | A1 | 11/2002 | Van Wagenen et al. | |
| 2004/0028855 | A1 | 2/2004 | Masuki et al. | |
| 2004/0214052 | A1 * | 10/2004 | Rochelo | 429/9 |
| 2006/0000738 | A1 | 1/2006 | Kumakura et al. | |
| 2008/0099370 | A1 * | 5/2008 | Foreman et al. | 206/703 |

FOREIGN PATENT DOCUMENTS

| | | |
|---|---|---|
| GB | 2053836 | 2/1981 |
| GB | 2327939 | 2/1999 |
| GB | 2413315 | 10/2005 |
| GB | 2422140 | 7/2006 |
| JP | 8324636 | 12/1996 |
| JP | 11227828 | 3/1999 |
| JP | 2003252332 | 9/2003 |

* cited by examiner

COMPACT INJECTION MOLDED BATTERY PACKAGE

FIELD OF THE INVENTION

The present invention relates to packaging, and in particular to packaging for batteries.

SUMMARY OF THE PRESENT INVENTION

An aspect of the present invention is to provide a battery package comprising a rear member and a front member pivotally connected to the rear member. The front member is pivotable about the rear member at a pivot, with the battery package having a closed position wherein the front member is engaged with the rear member and defining an interior space therebetween. The battery package also includes an open position allowing access to the interior space. Batteries are in the interior space. At least one of the front member and the rear member includes support structure for supporting the batteries in the interior space. A projection extends from the front member and the rear member, with the projection having an aperture for allowing the battery package to be hung on a rod. A first one of the front member and the rear member includes a latch and a second one of the front member and rear member includes a slot, with the latch being configured to be inserted into the slot for maintaining the battery package in the closed position.

Another aspect of the present invention is to provide a battery package comprising a rear member and a front member pivotally connected to the rear member. The front member is pivotable about the rear member at a pivot, with the battery package having a closed position wherein the front member is engaged with the rear member and defining an interior space therebetween. The battery package also includes an open position allowing access to the interior space. Batteries are in the interior space. A resealable closure allows the front member and the rear member to be maintained in the closed position. A projection extends from the front member and the rear member, with the projection having an aperture for allowing the battery package to be hung on a rod. The front member includes a first pivot member at a bottom thereof and the rear member includes a second pivot member at a bottom thereof, the first pivot member and the second pivot member engaging to allow the front member to pivot relative to the rear member about the pivot at a bottom of the battery package.

Yet another aspect of the present invention is to provide a package comprising a rear member and a front member pivotally connected to the rear member. The front member is pivotable about the rear member at a pivot, with the package having a closed position wherein the front member is engaged with the rear member and defining an interior space therebetween. The package also includes an open position allowing access to the interior space. At least one of the front member and the rear member includes support structure for supporting products in the interior space. A projection extends from the front member and the rear member, with the projection having an aperture for allowing the package to be hung on a rod. The rear member includes a foot allowing the package to stand substantially upright on a horizontal surface. A first one of the front member and the rear member includes a latch and a second one of the front member and rear member includes a slot, with the latch being configured to be inserted into the slot for maintaining the package in the closed position. The package can alternatively be positioned on the horizontal surface using the foot and be hung on a rod by extending the rod through the aligned openings for display purposes.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
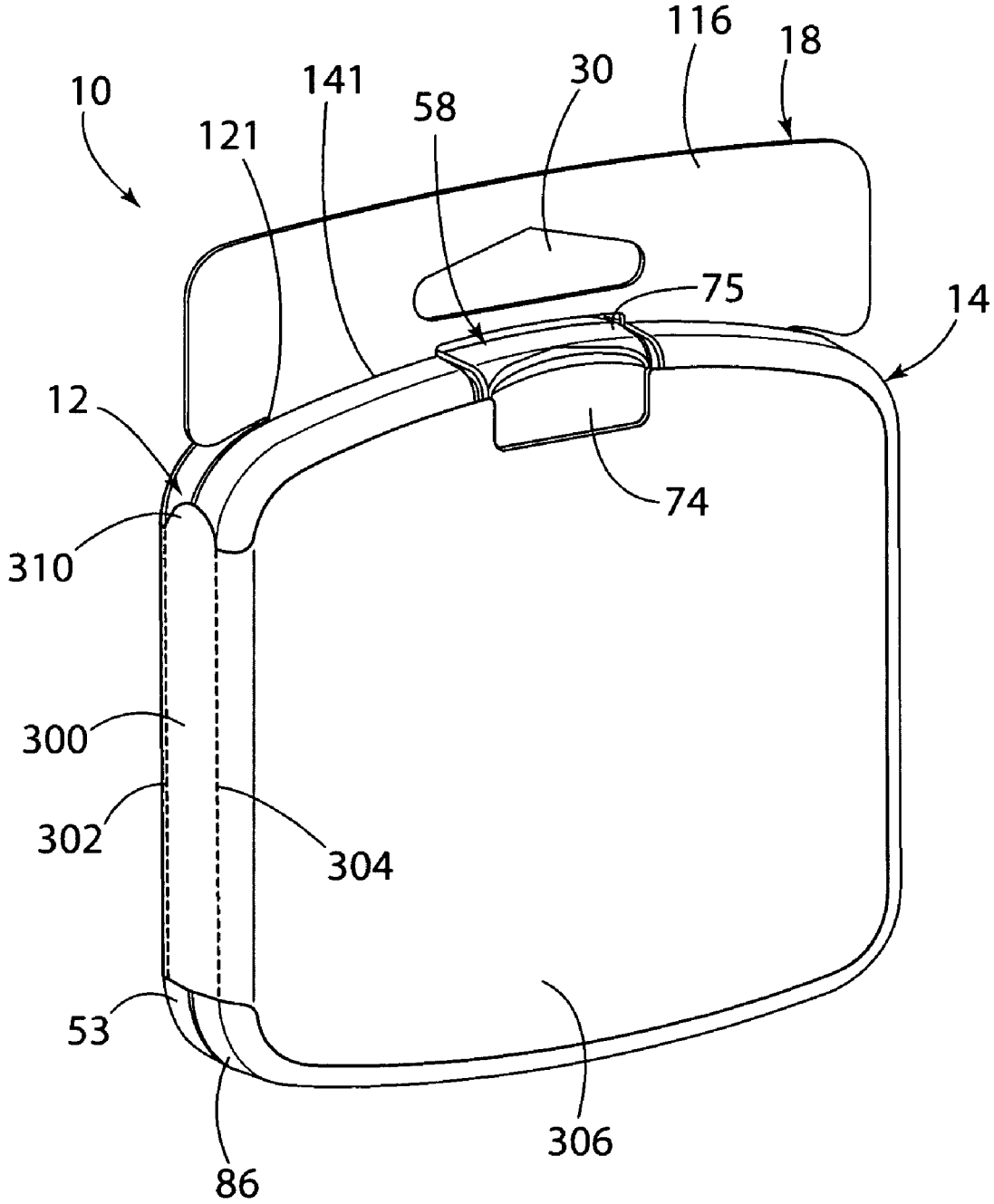
FIG. 1 is a perspective view of a battery package of the present invention in a closed configuration.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1, 2, 5 and 6) generally designates a package embodying the present invention. In the illustrated example, the package 10 comprises a rear member 12 and a front member 14 pivotally connected to the rear member 12. The front member 14 is pivotable about the rear member 12 at a pivot 20. The package 10 has a closed position (see FIG. 2A) wherein the front member 14 is engaged with the rear member 12 and defines an interior space 22 therebetween. The package 10 also has an open position (see FIG. 2B) allowing access to the interior space 22. The rear member 12 includes support structure 24 for supporting products in the interior space 22. The rear member 12 also includes a foot 26 allowing the package 10 to stand substantially upright on a horizontal surface 28 (see FIG. 2A). A first one of the front member 14 and the rear member 12 includes a latch 400 and a second one of the front member 14 and rear member 12 includes a slot 402, with the latch 400 being configured to be inserted into the slot 402 for maintaining the package 10 in the closed position. The package 10 also includes a projection 18 extending from the front member 14 and the rear member 12, with the projection 18 having an aperture 30 for allowing the package to be hung on a rod. The package 10 can alternatively be positioned on the horizontal surface 28 using the foot 26 and be hung on a rod (not shown) by extending the rod through the aperture 30 for display purposes. In the illustrated example, the products located within the package 10 are batteries 16. It is noted that FIG. 5 only shows one battery 16 for illustrative purposes. However, it is understood that more than one battery 16 can be located within the package 10 (see, for example, FIG. 6). It is contemplated that the products located within the package 10 could be any commercially available product.

The illustrated batteries 16 within the package 10 can comprise electrochemical cells for supplying voltage to battery powered devices. The batteries 16 can comprise any of the popular alkaline or lithium cells of the generally cylindrical shape that are commercially available in industry-recognized, standard sizes, including D-, C-, AA-, AAA-, and AAAA-size cells, as well as other sizes and configurations (e.g., 9 volt batteries). Alternatively, disc-shaped batteries commercially available for small electrically operated devices, such as hearing aids, could be used. In the illustrated embodiment, the package 10 includes four aligned cylindrical batteries 16 therein. However, it is contemplated that the package 10 could include any number of batteries 16 therein. Furthermore, it is contemplated that the package 10 could include different batteries 16 and/or a plurality of different size batteries 16.

In the illustrated example, the rear member 12 (FIGS. 4 and 5) includes the support structure 24 for supporting the products 16. However, it is contemplated that the front member 14 could include the support structure 24 for supporting the products 16 or that the front member 14 and the rear member 12 could each have support structure and work in combination (or separately) to support the products 16 in the interior space 22.

Figure 3:
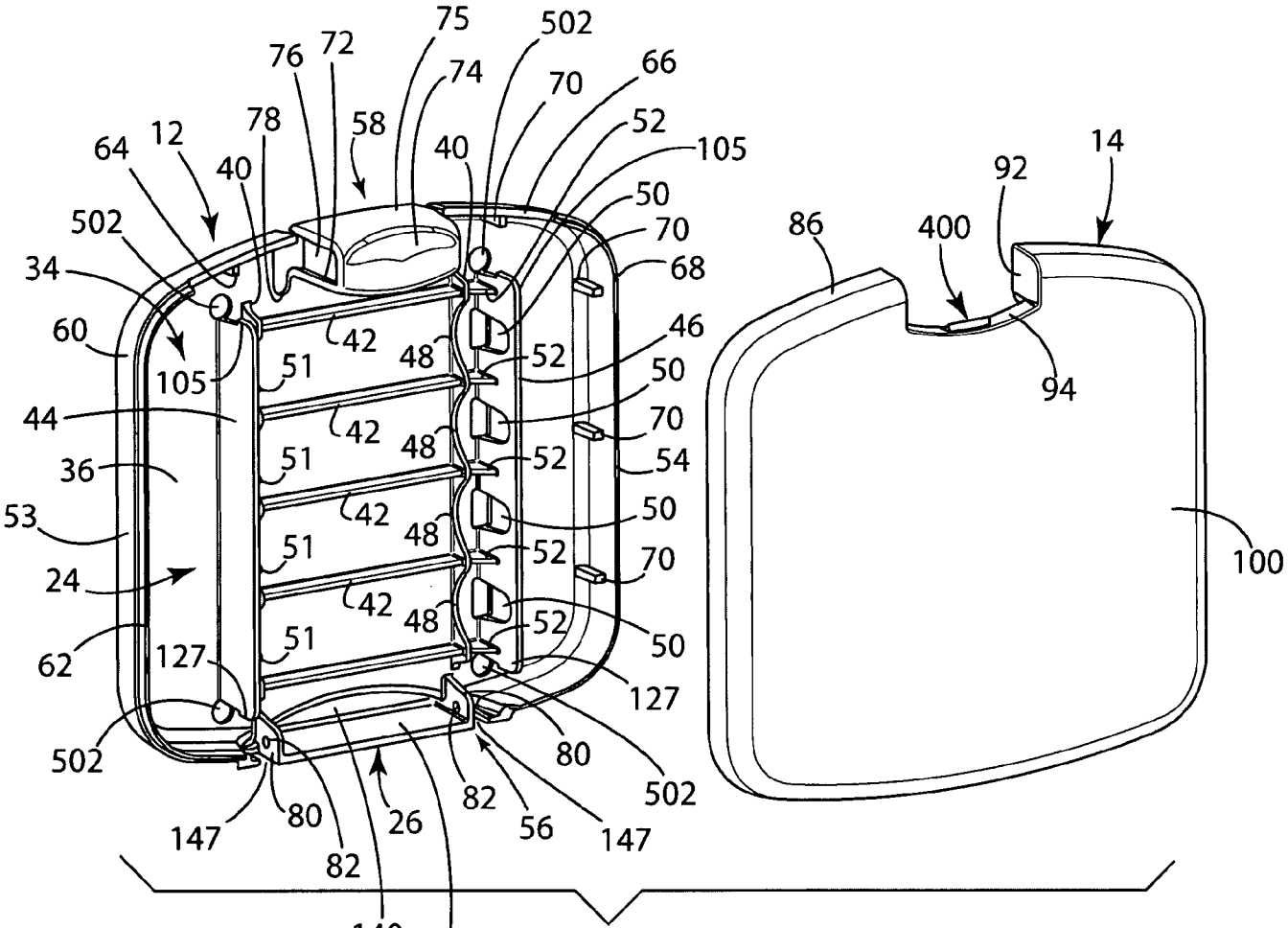
FIG. 3 is an exploded front perspective view of a front member and a rear member of the battery package.
Figure 6:
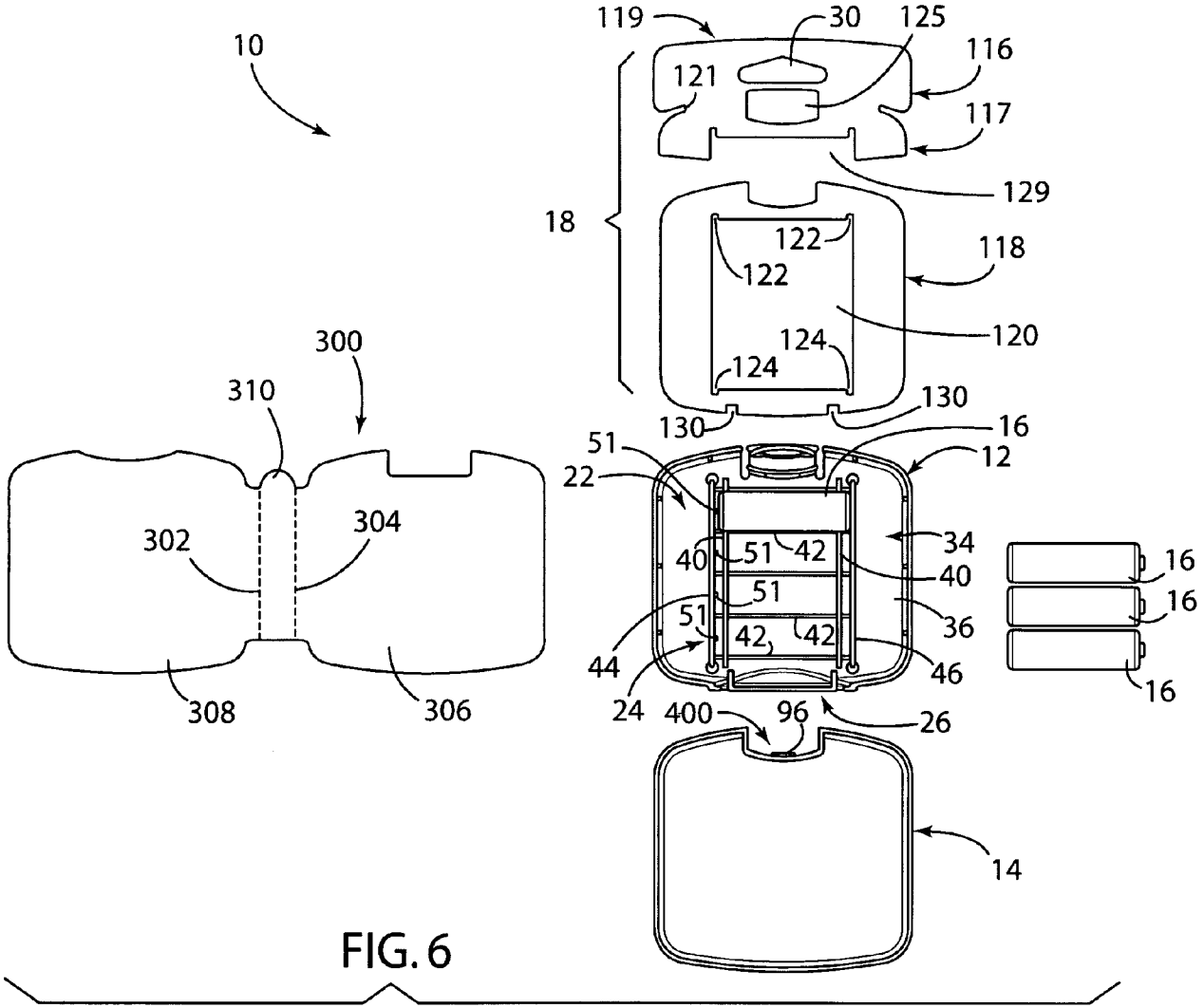
FIG. 6 is an exploded front view of the battery package of the present invention.

The illustrated rear member 12 is configured to support the products 16 from the rear. The rear member 12 includes a substantially rectangular rear section 34 having a front surface 36 for accepting the products 16 thereon. In the illustrated embodiment, the products 16 comprise four cylindrical batteries 16. However, as discussed above, any number and shape of batteries or any product could be used. As illustrated in FIGS. 3 and 6, the support structure 24 includes a pair of parallel support ribs 40, a plurality of cross-pieces 42, a first side product support wedge wall 44 and a second side product support wedge wall 46. The pair of parallel support ribs 40 extend from the front surface 36 in a vertical orientation. The support ribs 40 include a plurality of grooves 48 for accepting the batteries 16 thereon. As illustrated in FIGS. 3 and 6, each of the support ribs 40 include one of a pair of aligned grooves 48, with each end of one of the batteries 16 resting in one of the aligned grooves 48. In the illustrated example, the grooves 48 are annular to support an outer cylindrical surface of the batteries 16. However, it is contemplated that the grooves 48 could be any shape to accommodate the batteries 16 or other product in the package 10. For example, the grooves 48 could be triangular, three sides of a rectangle or any other shape configured to support ends of the batteries 16 or other products. It is also contemplated that additional support ribs 40 could be employed to support middle sections of the batteries 16 or the other products. The plurality of cross-pieces 42 extend between the parallel support ribs 40. The cross-pieces 42 provide support for the support structure 24 and the rear member 12. In the illustrated embodiment, five cross-pieces 42 are used. However, it is contemplated that any number of cross-pieces 42 (including none) could be used. Furthermore, while the rear section 34 is illustrated as being substantially rectangular, it is contemplated that the rear section 34 could have any geometric shape.

In the illustrated example, the first side product support wedge wall 44 and the second side product support wedge wall 46 maintain the batteries 16 on the support structure 24. The batteries 16 are configured to be wedged between the first side product support wedge wall 44 and the second side product support wedge wall 46 to maintain the batteries 16 on the support ribs 40. In the illustrated example, the second side product support wedge wall 46 includes a plurality of product extension openings 50. As illustrated in FIG. 6, an extension of the batteries 16 (e.g., a positive terminal) is configured to extend into one of the product extension openings 50 to assist in maintaining the batteries 16 between the first side product support wedge wall 44 and the second side product support wedge wall 46 and on the support ribs 40. It is contemplated that the first side product support wedge wall 44 could include a plurality of tabs 51 aligned with the product extension openings 50 to push the product (e.g., at a negative terminal of the batteries 16) into the openings 50. While the product extension openings 50 are illustrated as being in the second side product support wedge wall 46 and the tabs 51 are illustrated as being on the first side product support wedge wall 44, it is contemplated that the product extension openings 50 and the tabs 51 could be located in or on either or both of the first side product support wedge wall 44 and the second side product support wedge wall 46. It is further contemplated that struts 52 could extend between the support ribs 40 and each of the first side product support wedge wall 44 and the second side product support wedge wall 46 to provide stability to the first side product support wedge wall 44 and the second side product support wedge wall 46. Furthermore, it is contemplated that the support structure 24 could have a different configuration than that outlined herein. For example, the support structure 24 could capture the batteries 16 using grooves in walls, with the grooves extending more than 180° to be able to capture the batteries 16. Moreover, it is contemplated that the support structure 24 could only maintain the batteries 16 in position when the package 10 is in the closed position.

The illustrated rear member 12 can also include structure for providing stability to and for supporting the package 10 and for connecting the rear member 12 to the front member 14. For example, the rear member 12 can include a C-shaped first side wall 53 connected to a first side of the rear section 34, a C-shaped second side wall 54 connected to a second side of the rear section 34, a rear hinge member 56 connected to a bottom of the rear section 34, and a latch mechanism 58 including the slot 402 connected to a top of the rear section 34. The C-shaped first side wall 53 is connected to a periphery of the rear section 34 and includes a first side main portion 60 and a first side extension member 62 extending from a top of the first side main portion 60. A plurality of support flanges 64 extend between an inside surface of the first side main portion 60 of the C-shaped first side wall 53 and the rear section 34 to provide support for the C-shaped first side wall 53. The C-shaped second side wall 54 is also connected to a periphery of the rear section 34 and includes a second side main portion 66 and a second side extension member 68 extending from a top of the second side main portion 66. A plurality of support flanges 70 extend between an inside surface of the second side main portion 66 of the C-shaped second side wall 54 and the rear section 34 to provide support for the C-shaped second side wall 54. The first side extension member 62 and the second side extension member 68 assist in allowing the rear member 12 to mate with the front member 14 when the package 10 is in the closed position as discussed in more detail below.

Figure 4:
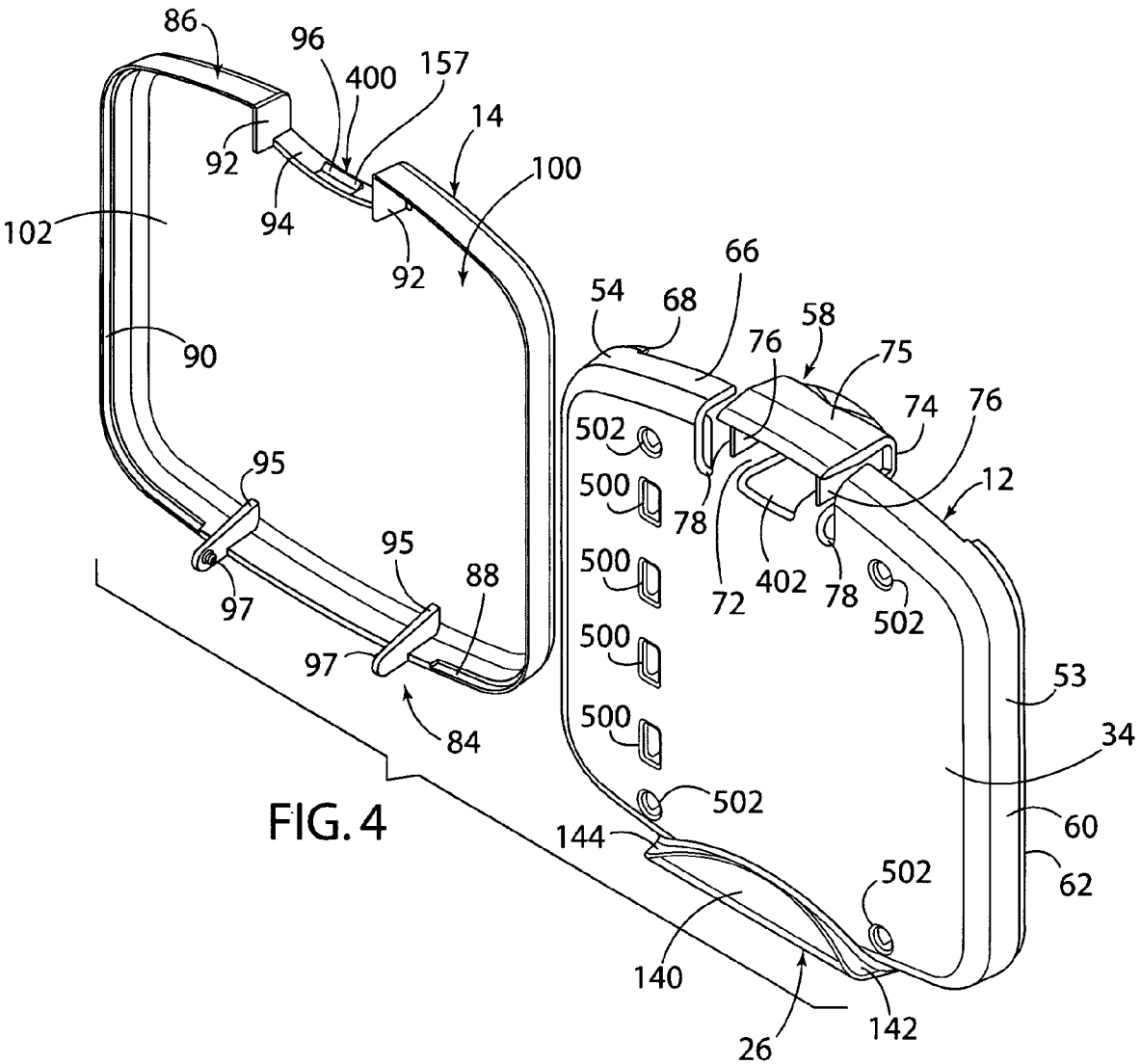
FIG. 4 is an exploded rear perspective view of the front member and the rear member of the battery package.

In the illustrated example, the rear member 12 includes the rear hinge member 56 for connecting the rear member 12 to the front member 14 and the latch mechanism 58 for maintaining the package 10 in the closed position. The rear hinge member 56 is connected to a bottom, middle portion of the rear section 34 of the rear member 12. The rear hinge member 56 includes a pair of parallel plates 80, with each of the plates 80 having a hole 82 therein. The holes 82 in the plates 80 are located along a line. The rear hinge member 56 is connected to a front hinge member 84 of the front member 14 to allow the rear member 12 to pivot relative to the front member 14 as discussed in more detail below. The latch mechanism 58 is connected to a top portion of the rear section 34 of the rear member 12 and includes a bottom panel 72 connected to the rear section 34 of the rear member 12, a front panel 74 connected to the bottom panel 72 at an edge opposite the edge connected to the rear section 34, a pair of side panels 76, and a top panel 75 connected to top edges of the front panel 74 and the side panels 76. As illustrated in FIGS. 3, 4 and 6, the rear section 34 of the rear member 12 includes a pair of notches 78 on either side of the bottom panel 72 of the latch mechanism 58 to allow the latch mechanism 58 to rotate relative to the rear member 12 because of the flexible material used to form the rear member 12. In the illustrated example, the bottom panel 72 includes the slot 402 therein. The slot 402 in the bottom panel 72 works with the latch 400 of the front member 14 to maintain the package 10 in the closed position as discussed in more detail below.

Figure 5:
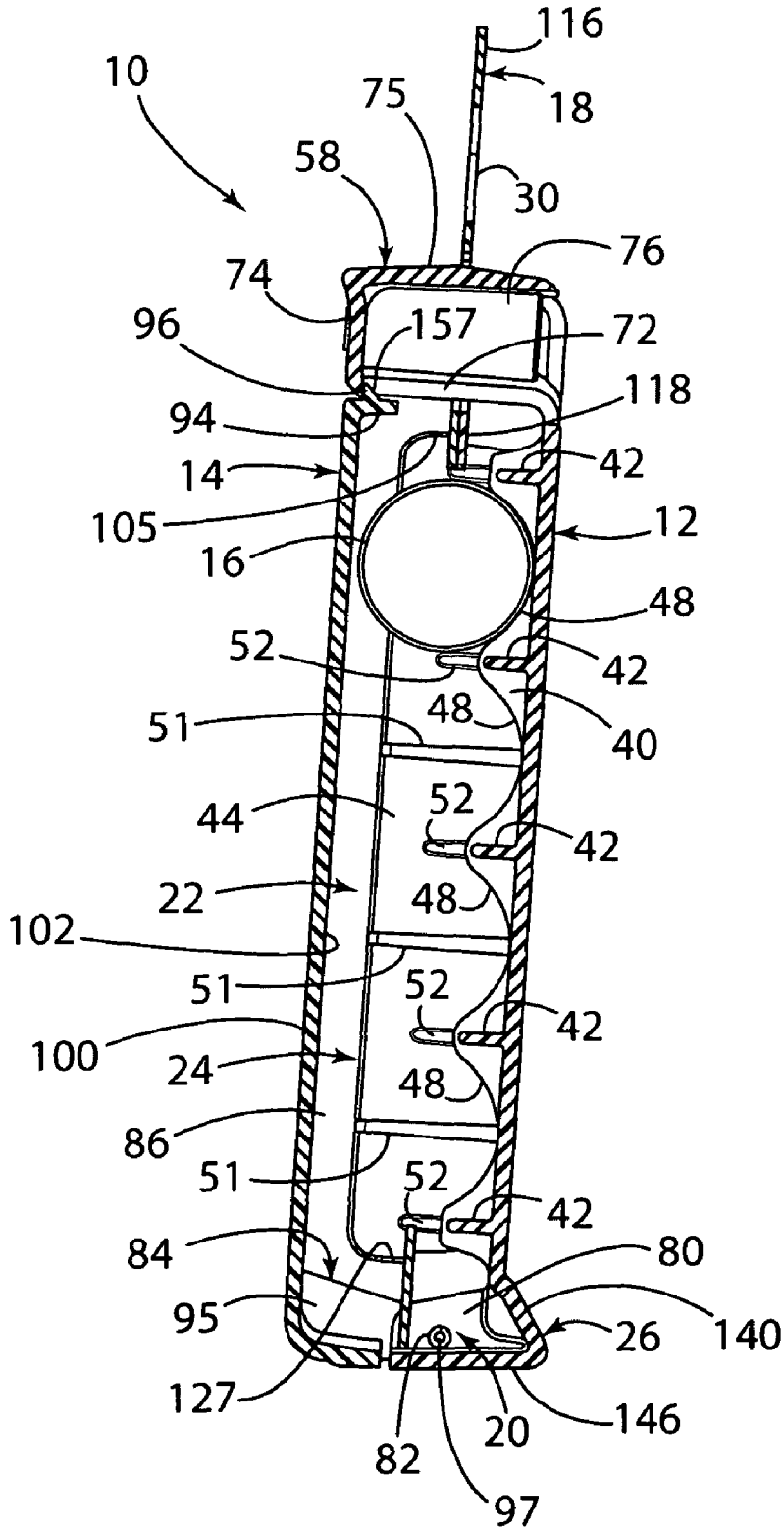
FIG. 5 is a cross-sectional view of the battery package of the present invention.

The illustrated front member 14 (FIGS. 2-6) is functionally connected to the rear member 12 and defines the interior space 22 when the package 10 is in the closed position. The front member 14 has a peripheral shape substantially corresponding to the peripheral shape of the rear member 12. The front member 14 includes a substantially rectangular front section 100 having a rear surface 102. The illustrated front member 14 can also include structure for providing stability to and for supporting the package 10. For example, the front member 14 can include an interrupted peripheral wall 86 surrounding most of the periphery of the front section 100. The interrupted peripheral wall 86 includes a first side C-shaped notch 88 located in a top, inside surface of the interrupted peripheral wall 86 on a first side thereof and a second side C-shaped notch 90 located in a top, inside surface of the interrupted peripheral wall 86 on a second side thereof. As discussed in more detail below, the first side extension member 62 of the C-shaped first side wall 53 and the second side extension member 68 of the C-shaped second side wall 54 of the rear member 12 are received within the first side C-shaped notch 88 and the second side C-shaped notch 90, respectively, when the package 10 is in the closed position. The front member 14 also includes a pair of parallel end flanges 92 at opposite ends of the interrupted peripheral wall 86. The latch 400 extends between the end flanges 92 and comprises a bowed plate 94 having a tab 96 extending upwardly therefrom. As illustrated in FIG. 5, the tab 96 of the latch 400 extends into the slot 402 when the package 10 is in the closed position. The front member 14 also includes the front hinge member 84. In the illustrated embodiment, the front hinge member 84 includes a pair of parallel panels 95, with each panel 95 having a pin 97 extending towards the other panel 95. The pins 97 are located along a line. The pins 97 of the front hinge member 84 of the front member 14 are configured to be inserted into the holes 82 in the plates 80 of the rear hinge member 56 of the rear member 12, thereby allowing the front member 14 to rotate relative to the rear member 12 and thereby forming the pivot 20.

As discussed above, the package 10 includes at least two features for displaying the package 10: the foot 26 and the aperture 30 of the projection 18. The illustrated rear member 12 includes the foot 26, which allows the package 10 to stand substantially upright on the horizontal surface 28 (see FIG. 2A). The foot 26 comprises an angled top wall 140, a first L-shaped side wall 142, a L-shaped second side wall 144 and a bottom wall 146. The angled top wall 140 extends rearwardly from a bottom of the rear section 34. The first side wall 142 and the second side wall 144 each connected to the angled top wall 140, a bottom of the rear section 34 and the bottom wall 146. As illustrated in FIG. 3, the pair of parallel plates 80 of the rear hinge member 56 are connected to a top surface of the bottom wall 146. The bottom wall 146 also includes a pair of notches 147 located outside of the parallel plates 80 for accepting the pair of parallel panels 95 of the front hinge member 84 therein for allowing the front member 14 to pivot relative to the rear member 12. The bottom wall 146 acts to allow the package 10 to stand substantially upright on the horizontal surface 28. It is contemplated that the foot 26 could have other configurations that allow the package 10 to stand substantially upright on the horizontal surface 28. For example, the walls could be curved and/or have any peripheral shape.

The illustrated battery package 10 includes the projection 18 extending from the front member 14 and the rear member 12, with the projection 18 having the aperture 30 for allowing the battery package 10 to be hung on a rod. The projection 18 can comprise a card. In the illustrated example, the projection 18 can comprise a principal projection component 116 and a secondary projection component 118. The principal projection component 116 includes a bottom portion 117 and a top portion 119, with a neck 121 separating the top portion 119 from the bottom portion 117. The aperture 30 is located in the top portion 119. The aperture 30 allows the package 10 to be hung on a rod in a store for display purposes as is well known to those skilled in the art. A latch mechanism opening 125 spans the top portion 119, the neck 121 and the bottom portion 117. When the principal projection component 116 is placed onto the rear member 12, the latch mechanism 58 extends through the latch mechanism opening 125. The bottom portion 117 of the principal projection component 116 has an M-shaped cut-out 129 for accepting tops of the parallel support ribs 40 and the area between the support ribs 40 therein. As illustrated in FIG. 3, the top ends of the support ribs 40 include top hooks 105, such that the bottom portion 117 of the principal projection component 116 will snap into place onto the rear member 12 between the top ends of the support ribs 40 under the top hooks 105 and top portions of the C-shaped first side wall 53 and the C-shaped second side wall 54. The principal projection component 116 is unitary and can be formed from any material (e.g., paper or plastic). The secondary projection component 118 is substantially rectangular and includes a shape conforming the shape defined by an inside surface of the C-shaped first side wall 53 and the C-shaped second side wall 54. The secondary projection component 118 includes a center opening 120 having top notches 122 and bottom notches 124. The support structure 24 fits within the center opening 120 when the secondary projection component 118 is placed onto the rear member 12. The top notches 122 allow the secondary projection component 118 to snap under the top hooks 105 and the bottom notches 124 allow the secondary projection component 118 to snap under bottom hooks 127 located at bottom ends of the support ribs 40 (see FIG. 3). The secondary projection component 118 also includes a pair of bottom notches 130 for accepting the pair of parallel panels 95 of the front hinge member 84 therein. It is contemplated that the projection 18 could only include the principal projection component 116 without any secondary projection component 118 or only the secondary projection component 118 without any principal projection component 116. The principal projection component 116 and the secondary projection component 118 are each unitary and can be formed from any material (e.g., paper or plastic).

FIG. 6 illustrates an exploded view of the battery package 10 during assembly of the battery package 10. In assembling the battery package 10, the battery package is positioned in the open position and the batteries 16 are placed within the support structure 24 as described above. The projection 18 is placed onto the rear member 12 as described above (with either the principal projection component 116 on top of the secondary projection component 118 or the secondary projection component 118 on top of the principal projection component 116). When the front member 14 is pivoted about the pivot 20 to engage the rear member 12 to move the battery package 10 to the closed position, the principal projection component 116 of the projection 18 will extend out of the front member 14 and the rear member 12 through a slot 141 located between first side extension member 62 and the second side extension member 68, with the neck 121 extending through the slot 141.

As described above, a first one of the front member 14 and the rear member 12 includes the latch 400 and a second one of the front member 14 and rear member 12 includes the slot 402, with the latch 400 being configured to be inserted into the slot 402 for maintaining the package 10 in the closed position. In the illustrated example, the front member 14 includes the latch 400 and the rear member 12 includes the slot 402. However, it is contemplated that the rear member 12 could include the latch 400 and the front member 14 could include the slot 402. In the illustrated embodiment, as the front member 14 is rotated relative to the rear member 12, the front panel 74 of the latch mechanism 58 will abut against a ramped surface 157 of the tab 96 of the latch 400, thereby moving the bottom panel 72 of the latch mechanism 58 upward. Once the front member 14 is fully engaged with the rear member 12, the tab 96 of the latch 400 will move into the slot 402 of the latch mechanism 58, thereby locking the package in the closed position. To open the package, the front panel 74 of the latch mechanism 58 is depressed, thereby forcing the latch mechanism 58 to rotate rearward between the notches 78 and moving the bottom panel 72 upward. The upward movement of the bottom panel 72 will allow the tab 96 of the latch 400 to be removed from the slot 402 and allow the package 10 to move to the open position. While the latch 400 and the slot 402 are illustrated as forming part of the front member 14 and the rear member 12, it is contemplated that the latch 400 and the slot 402 could form their own structure on the front and rear members, could be located on the side, top or bottom walls of the front and rear members or could be located elsewhere.

Figure 2A:
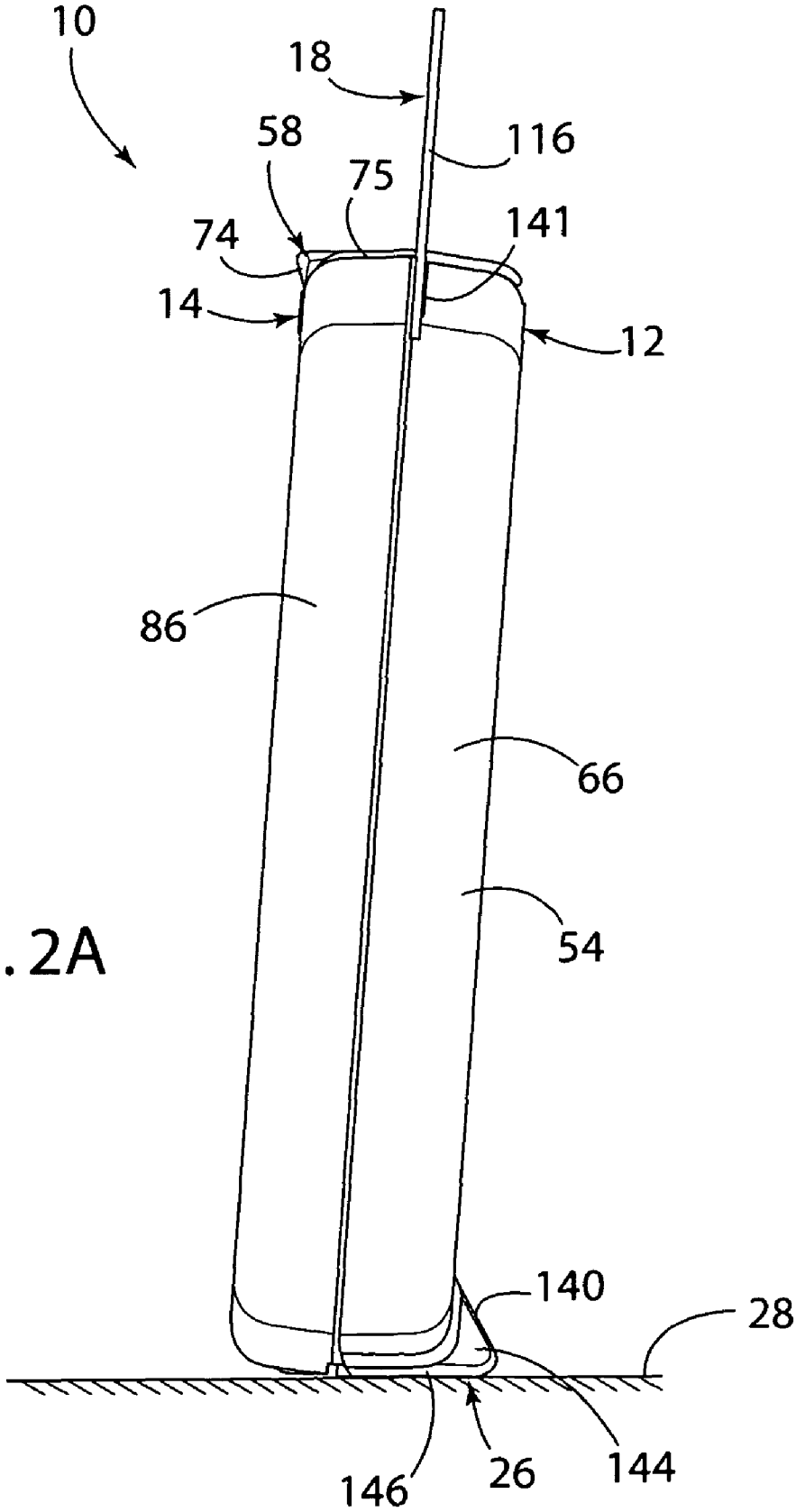
FIG. 2A is a side view of the battery package of the present invention in the closed configuration.
Figure 2B:
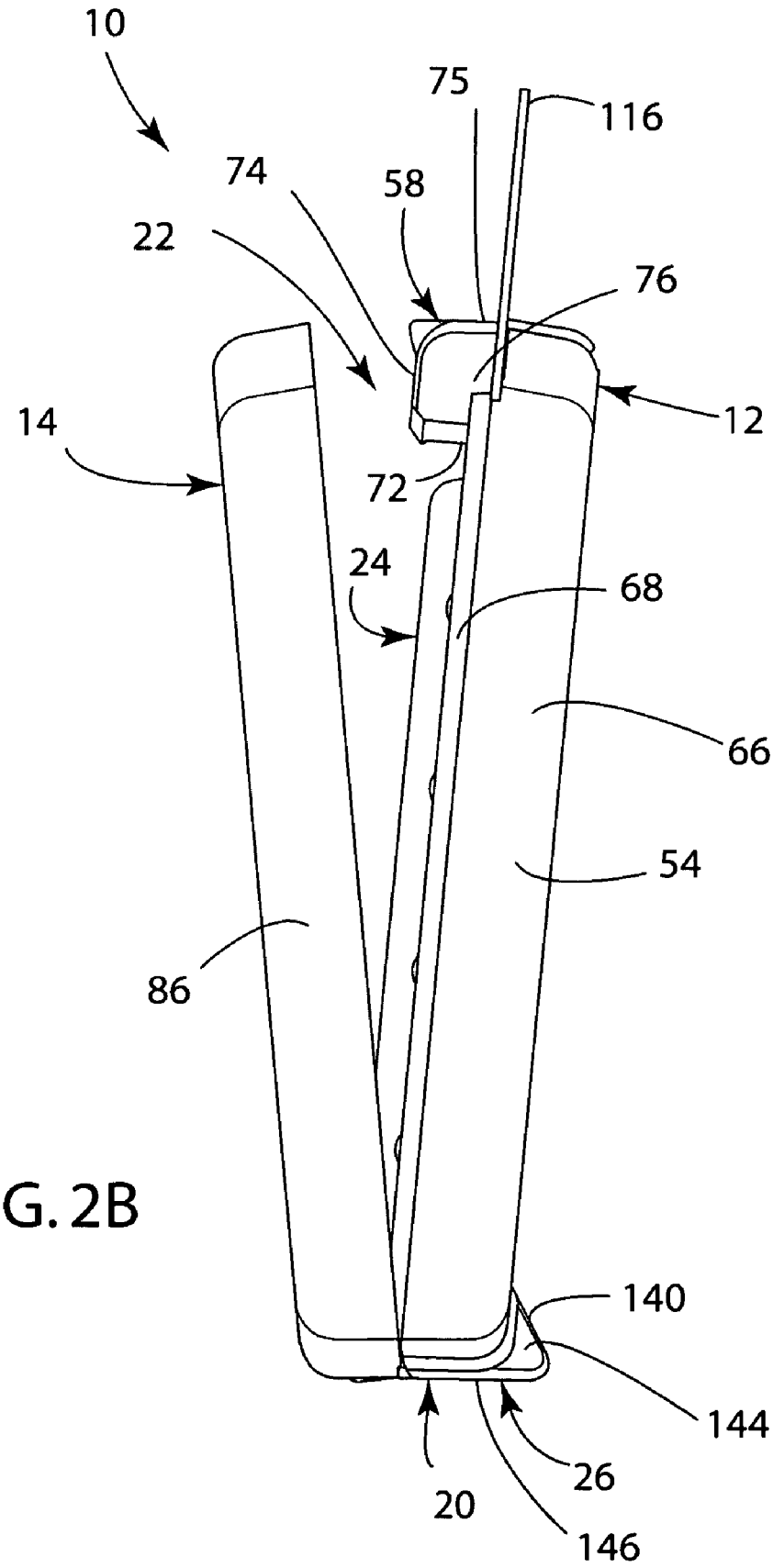
FIG. 2B is a side view of the battery package of the present invention in an open configuration.

The illustrated package 10 can be easily formed and batteries can easily be packaged in the package 10. It is contemplated that the front member 14 and the rear member 12 can be injection molded. If injection molded or molded in other fashions, the rear member 12 could include first holes 500 (see FIG. 5) for allowing a portion of the mold to form the plurality of product extension openings 50 in the second side product support wedge wall 46 (or the first side product wedge support wall 44) and second holes 502 for forming the top hooks 105 and the bottom hooks 127. The batteries 16 can also be placed onto the rear member 12 and the package 10 can be moved to the closed configuration to thereby package the batteries 16 in the package 10. It is also contemplated that the package 10 can be formed of any formable material (e.g., plastic (e.g., PETG)) and can be formed or molded in any manner. Furthermore, it is contemplated that any portion or the entire package 10 can be transparent, translucent or opaque. It is also contemplated that a sleeve 300 could surround the package (see FIG. 6) and can include material printed thereon for advertising or informational purposes. The sleeve 300 can include a front portion 306 adhered to the front member 14 and a rear portion 308 adhered to the rear member 12. A pull tab 310 is located between the front portion 306 and the rear portion 308 of the sleeve 300. The pull tab 310 can be pulled at a top thereof such that the pull tab 310 will tear along a front perforation 304 between the pull tab 310 and the front portion 306 and a rear perforation 302 between the pull tab 310 and the rear portion 308, thereby allowing the front portion 306 to remain attached to the front member 14 and the rear portion 308 to remain attached to the rear member 12 and thereby allowing the front member 14 to be rotated relative to the rear member 12 (after depression of the front panel 74 of the latch mechanism 58). Furthermore, it is contemplated that the package 10 can be inclined on the support surface (as illustrated in FIG. 2A) or can be vertical relative to the support surface. Moreover, it is contemplated that the package 10 could be entirely or almost entirely covered by a shrink wrap sleeve.

It is to be understood that variations and modifications can be made on the aforementioned structure without departing from the concepts of the present invention. It is to be understood that such concepts as described herein are intended to be covered by the following claims unless these claims by their language expressly state otherwise.

We claim:

1. A battery package comprising:

a rear member comprising a foot, the foot having an angled top wall and an L-shaped wall, the rear member being injection molded and translucent;

a front member pivotally connected to the rear member;

the front member being pivotable about the rear member at a pivot, with the battery package having a closed position wherein the front member is engaged with the rear member and defining an interior space therebetween, the battery package also including an open position allowing access to the interior space;

a resealable closure to selectively maintain the closed position;

batteries in the interior space;

the rear member including support structure for supporting the batteries in the interior space, wherein the support structure comprises at least one wedge wall;

a projection extending from the front member and the rear member, the projection having an aperture for allowing the battery package to be hung on a rod; and holes through a rear surface of the rear member, with the holes extending through the at least one wedge wall forming a plurality of openings therethrough for accepting battery terminals.

2. The battery package of claim 1, wherein:

the projection is separate from the rear member and the front member.

3. The battery package of claim 2, wherein:

the projection comprises a card extending out a slot located between the front member and the rear member, with the card having the aperture therein.

4. The battery package of claim 1, wherein:

the L-shaped wall of the foot includes a bottom surface, with the bottom surface abutting a horizontal surface when the battery package is positioned on the horizontal surface.

5. The battery package of claim 1, wherein:

the front member includes a first pivot member at a bottom thereof and the rear member includes a second pivot member at a bottom thereof, the first pivot member and the second pivot member engaging to allow the front member to pivot relative to the rear member at a bottom of the battery package.

6. The battery package of claim 5, wherein:

the first pivot member comprises a pair of pins and the second pivot member comprises a pair of holes, with the pins being located within the holes.

7. The battery package of claim 1, wherein:

the support structure comprises a pair of aligned wedge walls for maintaining the batteries on the support structure;

the batteries are cylindrical and have a positive terminal and a negative terminal at ends of the cylinder; and the ends of the cylinder are wedged between the wedge walls.

8. The battery package of claim 7, wherein:

the support structure also includes a plurality of grooves for accepting the cylinder thereon.

9. The battery package of claim 1, wherein the package can alternatively be positioned on a horizontal surface using the foot and be hung on the rod by extending the rod through the aperture.

10. The battery package of claim 1, wherein a sleeve is adhered to the rear surface of the rear member and covers the holes through the rear member.

* * * * *